US009222401B2

(12) United States Patent
Inoue et al.

(10) Patent No.: US 9,222,401 B2
(45) Date of Patent: Dec. 29, 2015

(54) COOLANT PASSAGE APPARATUS FOR INTERNAL COMBUSTION ENGINE

(75) Inventors: Fujio Inoue, Kiyose (JP); Hiroyasu Koyama, Toyota (JP)

(73) Assignees: NIPPON THERMOSTAT CO., LTD., Kiyose-shi (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 170 days.

(21) Appl. No.: 13/146,873

(22) PCT Filed: Feb. 23, 2010

(86) PCT No.: PCT/JP2010/001177
§ 371 (c)(1),
(2), (4) Date: Jul. 28, 2011

(87) PCT Pub. No.: WO2010/098068
PCT Pub. Date: Sep. 2, 2010

(65) Prior Publication Data

US 2011/0284182 A1 Nov. 24, 2011

(30) Foreign Application Priority Data

Feb. 25, 2009 (JP) ..... 2009-041771

(51) Int. Cl.
*F01P 11/04* (2006.01)

(52) U.S. Cl.
CPC ..... *F01P 11/04* (2013.01)

(58) Field of Classification Search
CPC ..... F01P 11/04
USPC ..... 165/48.1, 51; 123/41.01, 41.44, 41.5
See application file for complete search history.

(56) References Cited

U.S. PATENT DOCUMENTS

| | | | | |
|---|---|---|---|---|
| 4,745,885 | A * | 5/1988 | Koinuma | 123/41.05 |
| 4,813,848 | A * | 3/1989 | Novotny | 416/95 |
| 5,487,363 | A | 1/1996 | Batzill et al. | |
| 6,405,689 | B1 | 6/2002 | Iijima | |
| 7,082,915 | B2 * | 8/2006 | Tanikawa et al. | 123/184.42 |

(Continued)

FOREIGN PATENT DOCUMENTS

| | | |
|---|---|---|
| JP | 4-16610 B2 | 3/1992 |
| JP | 7-139348 A | 5/1995 |

(Continued)

OTHER PUBLICATIONS

International Search Report for PCT/JP2010/001177, mailing date of Jun. 8, 2010.

*Primary Examiner* — Lindsay Low
*Assistant Examiner* — Jacob Amick
(74) *Attorney, Agent, or Firm* — Westerman, Hattori, Daniels & Adrian, LLP

(57) ABSTRACT

A pair of coolant receiving pipes (23) and (24) for respectively receiving a coolant from left and right engine heads of a V-engine are provided on a first body (21) side, and a collecting passage (27) for collecting the coolant, communication opening (30*a*) towards a radiator via the above-mentioned collecting passage (27) and communication opening (31*a*) towards a branch passage provided with a heater core part or the like are provided on a second body (22) side and these are individually resin molded. A coolant passage apparatus (10) is formed by joining the above-mentioned first body (21) and second body (22) for example by welding means.

7 Claims, 7 Drawing Sheets

(56) References Cited

U.S. PATENT DOCUMENTS

| | | | | |
|---|---|---|---|---|
| 7,357,110 | B2 * | 4/2008 | Hashimoto et al. | 123/184.47 |
| 7,581,522 | B2 * | 9/2009 | Enokida | 123/184.34 |
| 2003/0024496 | A1 * | 2/2003 | Tachibana et al. | 123/184.47 |
| 2006/0062684 | A1 * | 3/2006 | Zahrah et al. | 419/66 |

FOREIGN PATENT DOCUMENTS

| | | | | |
|---|---|---|---|---|
| JP | 2000-356133 | A | | 12/2000 |
| JP | 2003-222248 | A | | 8/2003 |
| JP | 2008-232098 | A | | 10/2008 |
| JP | 2008232098 | A | * | 10/2008 |

* cited by examiner

COOLANT PASSAGE APPARATUS FOR INTERNAL COMBUSTION ENGINE

TECHNICAL FIELD

The present invention relates to a coolant passage apparatus used suitably for a cooling device which cools an internal combustion engine (hereinafter also referred to as engine) by circulating a coolant between a fluid passage formed in the internal combustion engine and a radiator.

BACKGROUND ART

In this type of engine cooling device, it is arranged that not only an engine is cooled by circulating a coolant between a fluid passage formed in the internal combustion engine and a radiator but also the coolant is supplied to a heater circulation channel provided with a heater core for heating. Furthermore, in these days it is proposed that the coolant from the engine is also used for an ATF warmer or an EGR cooler.

Therefore, as described above, in order that the coolant is circulated in or supplied to each part, it becomes necessary to use a branch pipe separately and connect it to piping. Thus, there arises a problem that the piping becomes complicated and worsens engine maintenance.

Then, in order to simplify connection of the pipes described above, a coolant passage apparatus is disclosed in cited literature shown below in which the piping is directly attached to a coolant discharging outlet of the engine, a thermo valve is accommodated in the piping, and connection parts of the pipes are collected.

CITATION LIST

Patent Literature

Patent Literature 1: Japanese Patent Publication No. H4-16610

DISCLOSURE OF THE INVENTION

Problems to be Solved by the Invention

Incidentally, the coolant passage apparatus disclosed in the above-mentioned cited literature has a considerably complicated structure including, for example, a collecting pipe for receiving and collecting the coolant by directly connecting to a pair of respective banks of a V-engine, a by-pass passage, an outlet for supplying the coolant to a radiator, an inlet for receiving the coolant from the radiator, a piping connection part for a water pump, etc.

In such a coolant passage apparatus, the whole apparatus is molded from a metal material, so that the molding process is not so easy. Thus, there arises a problem in that the molding process adds costs and increases its weight.

The present invention is invented by paying attention to a point that whole coolant passage apparatus is formed from a synthetic resin. The present invention aims to provide a coolant passage apparatus in which it is possible to achieve a weight reduction and cost reduction by exploiting the ease of molding resin, obtain sufficient machining accuracy with respect to a required position and the whole apparatus can absorb and disperse stress imposed on the apparatus, and it is also possible to effectively cope with the stress caused by thermal expansion of the engine and an offset of a joint caused by a difference in thermal expansion coefficient between the engine and the coolant passage apparatus.

Means to Solve the Problem

The coolant passage apparatus used for the internal combustion engine in accordance with the present invention made in order to solve the above-mentioned problems is a coolant passage apparatus used for a cooling device of an internal combustion engine in which a circulation channel for a coolant is formed between a fluid passage formed in the V-internal combustion engine and a radiator, and provided between a coolant outlet of the above-mentioned internal combustion engine and a coolant inlet of the radiator, characterized in that the above-mentioned coolant passage apparatus is formed by joining a plurality of resin moldings which are each individually molded, and at least a pair of coolant receiving pipes for respectively receiving the coolant from left and right engine heads of the above-mentioned V-internal combustion engine and a communicating tube which is towards the radiator for supplying the coolant to the radiator are formed therein, and the above-mentioned one pair of coolant receiving pipes are integrally molded in one resin molding of a plurality of the above-mentioned resin moldings.

In this case, in a preferred embodiment, the above-mentioned resin molding is constituted by two resin moldings of a first body and a second body, and a junction face between the above-mentioned first body and the second body is formed so as to be parallel to a plane along an axial direction of a crankshaft of the above-mentioned internal combustion engine.

Further, in another preferred embodiment, the above-mentioned resin molding is constituted by two resin moldings of the first body and the second body, and the junction face between the above-mentioned first body and the second body is formed so as to be parallel to a plane orthogonal to the axial direction of the crankshaft of the above-mentioned internal combustion engine.

For example, the engine can be arranged in an inclined position instead of in a vertical position. Further, any structure can be employed in which the junction face is not arranged between the above-mentioned one pair of coolant receiving pipes.

In any of aforementioned structures, it is arranged that a collecting passage for causing the one pair of coolant receiving pipes to communicate therewith and collecting the coolant is formed in the above-mentioned coolant passage apparatus and the above-mentioned communicating tube which is towards the radiator is formed via the collecting passage.

On the other hand, in still another preferred embodiment, it is arranged that the junction portion of the above-mentioned first body and the second body, viewed from above the coolant passage apparatus, is formed in a straight line in a region surrounded by respective vertical planes which are orthogonal to a plane defined by connecting the junction portion of the above-mentioned first body and the second body and pass through central axes of the above-mentioned pair of coolant receiving pipes.

Further, the above-mentioned one pair of coolant receiving pipes are preferably formed in an elliptical shape, being of a large inner diameter in a direction orthogonal to a plane which connects the central axes of respective pipes, and a small inner diameter in a direction of a plane which connects the above-mentioned central axes.

Furthermore, flange-like joints are preferably formed respectively around openings of the above-mentioned one pair of coolant receiving pipes and each of the joints has formed therein bolt inserting long holes along a bank angle from the crankshaft towards the left and right engine heads.

Effect of the Invention

The coolant passage apparatus for the internal combustion engine in accordance with the present invention is formed by joining a plurality of the resin moldings which are each individually molded, and it is arranged that the one pair of coolant receiving pipes for respectively receiving the coolant from the left and right engine heads of the V-internal combustion engine is integrally molded in one resin molding of a plurality of the above-mentioned resin moldings. It is thereby possible to effectively prevent stress due to thermal expansion of the V-internal combustion engine from being concentrated on the junction portion of the resin molding.

Further, since the coolant passage apparatus is formed by joining a plurality of the resin moldings which are each individually molded, upon resin molding, it is possible to adopt a reasonable molding method such as demolding. Furthermore, it is possible to achieve further cost reduction and weight reduction by exploiting a feature of the resin molding.

Still further, by employing such a structure that the resin molding is constituted by the first body and the second body and specific portion of the junction portion is formed in a straight line, a cross-sectional shape of the above-mentioned one pair of coolant receiving pipes are formed in an elliptical shape and the flange-like joints formed around the openings of the coolant receiving pipes have formed therein bolt inserting long holes along a bank angle from the crankshaft towards the left and right engine heads, it is possible to provide the coolant passage apparatus which can effectively cope with thermal expansion of the V-internal combustion engine with increasing temperature of the coolant and stress caused by difference in amount of thermal expansion between the engine heads and the coolant passage apparatus.

As described above, by resinification of the coolant passage apparatus, it becomes easy to add a connecting part to each device, for example, an EGR cooler and an ATF warmer. And where a connecting pipe must be press-fitted and jointed separately if the coolant passage apparatus is formed from a metal material such as aluminum, since the present coolant passage apparatus is made of resin, the above-mentioned pipe can be formed integrally.

DESCRIPTION OF EMBODIMENTS

Figure 1:
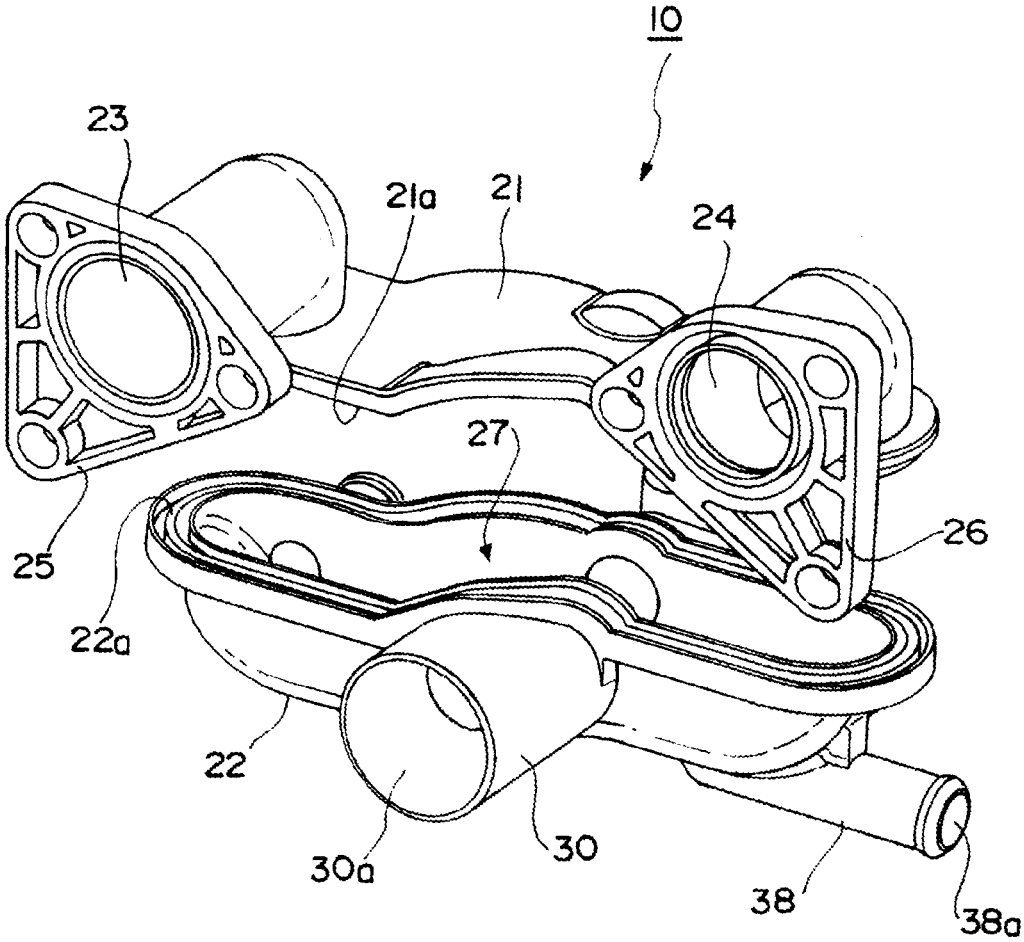
FIG. 1 is a perspective view showing a first preferred embodiment of a coolant passage apparatus in accordance with the present invention which is separated into first and second bodies.

Hereinafter, a coolant passage apparatus in accordance with the present invention will be described with reference to the preferred embodiments shown in the drawings. FIGS. 1 through 4 show a first preferred embodiment. In addition, this preferred embodiment will be described with reference to an example in which the apparatus is mounted to a V-engine and the coolant from right and left engine heads is collected in the above-mentioned coolant passage apparatus 10.

FIG. 1 is a perspective view showing a first body 21 and second body 22 respectively which are formed from a synthetic resin and constitute the above-mentioned coolant passage apparatus 10. The above-mentioned first body 21 and second body 22 are provided with peripheral junction portions 21*a* and 22*a* which are open and face each other. Annular welded portions (shown by same reference characters as junction portions 21*a* and 22*a*) each planarly formed are formed along these junction portions 21*a* and 22*a*.

The above-mentioned first body 21 and second body 22 are preferably welded in a situation where the junction portions 21*a* and 22*a* are overlapped so as to be formed into one casing. The above-mentioned junction portions 21*a* and 22*a* can be joined together preferably by way of vibration welding, or other means such as threaded engagement using a bolt and adhesives.

Figure 2:
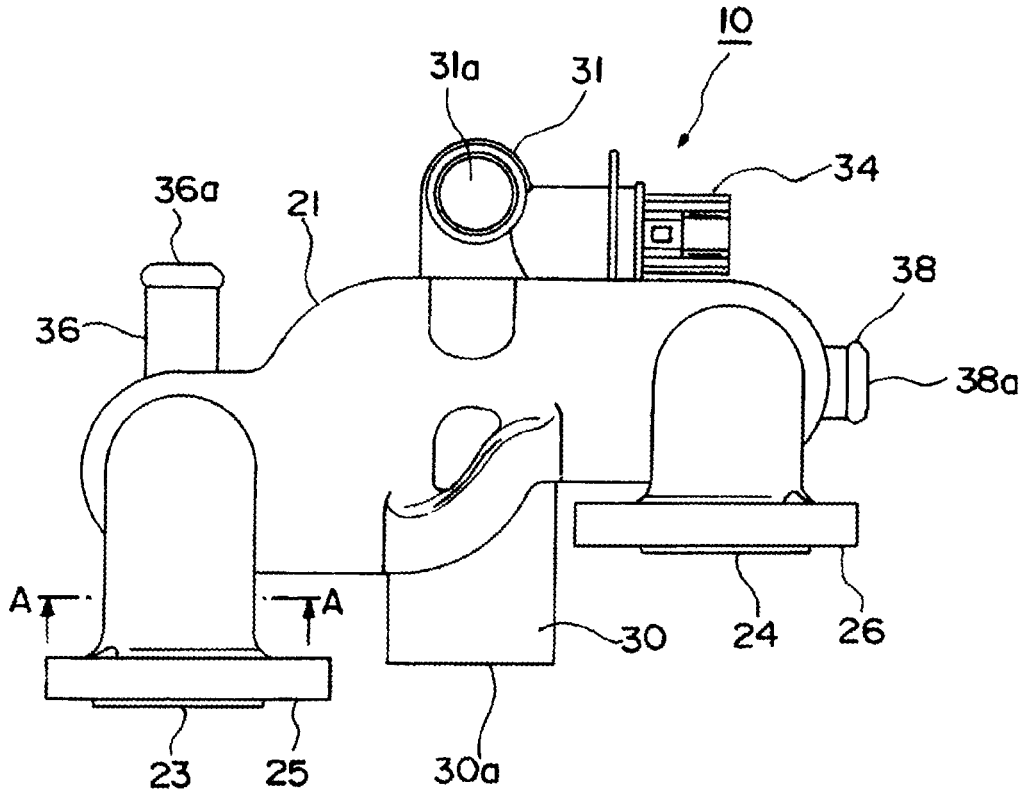
FIG. 2 is a plan view of the first preferred embodiment.
Figure 3:
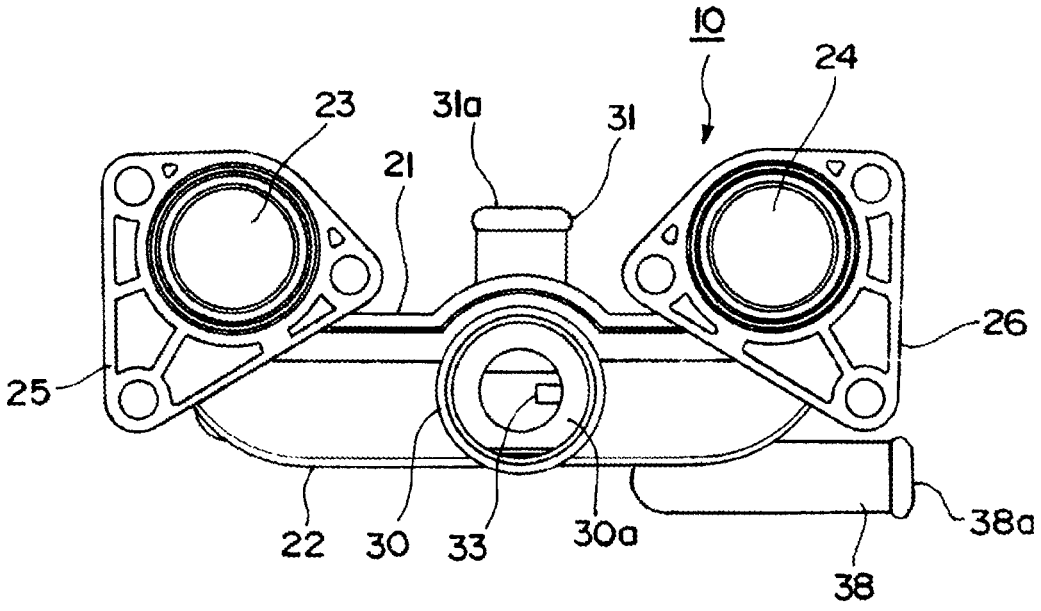
FIG. 3 is a front view of the first preferred embodiment.
Figure 4:
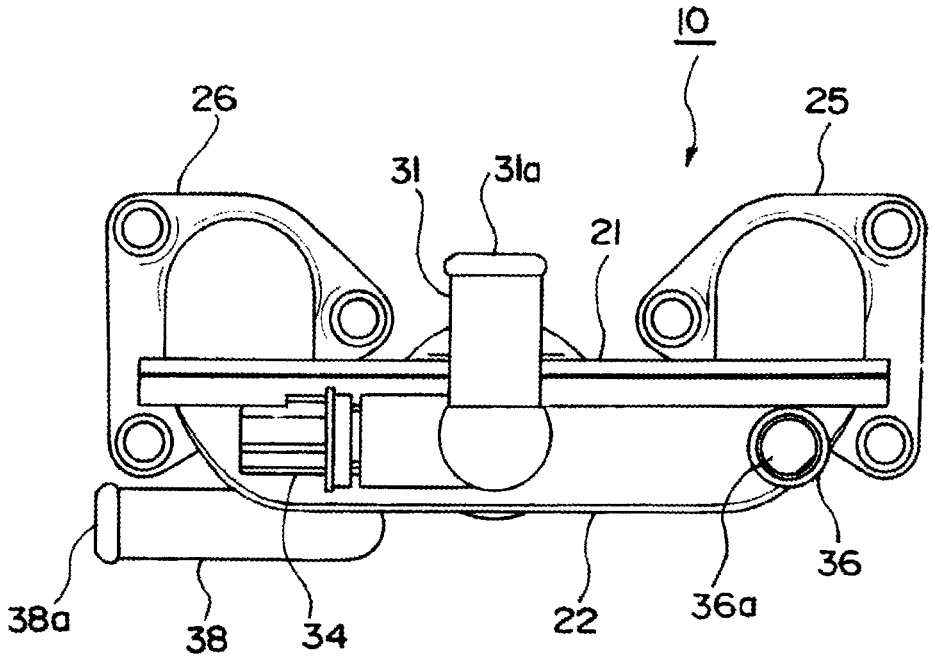
FIG. 4 is a rear view of the first preferred embodiment.

FIGS. 2 to 4 are plan view, front view and rear view showing the coolant passage apparatus 10 joined and molded integrally by the above-mentioned vibration welding or adhesives. Hereinafter, whole configuration of the coolant passage apparatus 10 is explained with reference to figures in which same reference characters identify the same parts.

A pair of coolant receiving pipes 23 and 24 which respectively receive the coolant from the left and right engine heads of the V-engine are molded to the first body 21 which constitutes the above-mentioned coolant passage apparatus 10 so as to respectively face the same direction, and flange-like joints (flange) 25 and 26 are formed around openings of the above-mentioned one pair of coolant receiving pipes 23 and 24.

The above-mentioned one pair of coolant receiving pipes 23 and 24 are communicated within the coolant passage apparatus 10 as shown in FIG. 1, and a collecting passage 27 for collecting the coolant from the one pair of coolant receiving pipes 23 and 24 is formed. In addition, this collecting passage 27 is formed so as to fill most of the space within the above-mentioned second body 22.

Communicating tube 30 which is towards a radiator (not shown) is formed substantially in the center of the above-mentioned collecting passage 27 of the above-mentioned second body 22 so as to communicate with the collecting passage 27. In other words, a communication opening 30*a* is formed in the communicating tube 30 which is towards the radiator so as to face the same direction as the openings of the above-mentioned coolant receiving pipes 23 and 24. Therefore, when the coolant passage apparatus 10 is mounted to the V-engine heads by using the above-mentioned joints 25 and 26, connecting pipe (not shown) for connecting the above-mentioned communicating tube 30 with the above-mentioned radiator is arranged between the left and right engine heads of the V-engine.

On the other hand, a communicating tube 31 having a communication opening 31*a* therein which is towards a heater core part (not shown) used as a heat exchanger for heating a car room is formed substantially at the center of the above-mentioned collecting passage 27 in the above-mentioned coolant passage apparatus 10 as shown in FIGS. 2 and 3. This communicating tube 31 is formed on the opposite side of the above-mentioned communicating tube 30 which is towards the radiator around the above-mentioned collecting passage 27. This communicating tube 31 is formed to be inclined upwards at right angles from the center part of the second body 22.

It is to be noted that in this embodiment, a water temperature sensor 33 is arranged inside the above-mentioned communicating tube 31 inclined upwards at right angles from the center part of the second body 22 (FIG. 3). Further, reference character 34 shown in FIGS. 2 and 4 denotes a connector of the above-mentioned water temperature sensor 33 which is attached outside the second body 22.

Furthermore, a communicating tube 36 having a communication opening 36*a* therein which is towards an ATF warmer is formed so as to communicate with the above-mentioned collecting passage 27. The communicating tube 36 is formed at the one end of the above-mentioned second body 22, that is to say, on the above-mentioned coolant receiving pipe 23 side so as to face the opposite side of the above-mentioned pipe 23. As is well known, this is used to shorten warm-up time for an automatic transmission AT and improve fuel consumption immediately after starting.

Still further, at the other end of the above-mentioned second body 22, that is to say, on the lower bottom of the above-mentioned coolant receiving pipe 24 side, a communicating tube 38 having a communication opening 38*a* therein which is towards an EGR cooler is formed so as to communicate with the above-mentioned collecting passage 27. It is to be noted that the above-mentioned communication opening 38*a* which is towards the EGR cooler is formed from the above-mentioned the other side of the second body 22 towards the outside. As is well known, this is used to cool EGR gas of the engine.

According to the above-mentioned embodiment, in the coolant passage apparatus 10, the coolant receiving pipes 23 and 24, communicating tube 30 towards the radiator, communicating tube 31 towards a branch passage in which the heater core part is interposed, communicating tube 36 towards the ATF warmer, communicating tube 38 towards the EGR cooler are formed so as to avoid the junction portion of the above-mentioned first body and second body. It is thereby possible to mold the respective communicating tubes and openings with high dimensional accuracy.

In addition, according to the above-mentioned embodiment, in the case where the apparatus is directly connected to the V-engine, since the one pair of coolant receiving pipes 23 and 24 are formed into only one body, that is, integrally formed in the first body 21, stress caused by thermal expansion of the V-internal combustion engine and difference in thermal expansion between the engine heads and the coolant passage apparatus is imposed only on the integrally molded first body 21 side. Thus, the stress is not concentrated on the junction portion of two bodies. It is thereby possible to effectively prevent the coolant passage apparatus from being damaged.

Figure 5:
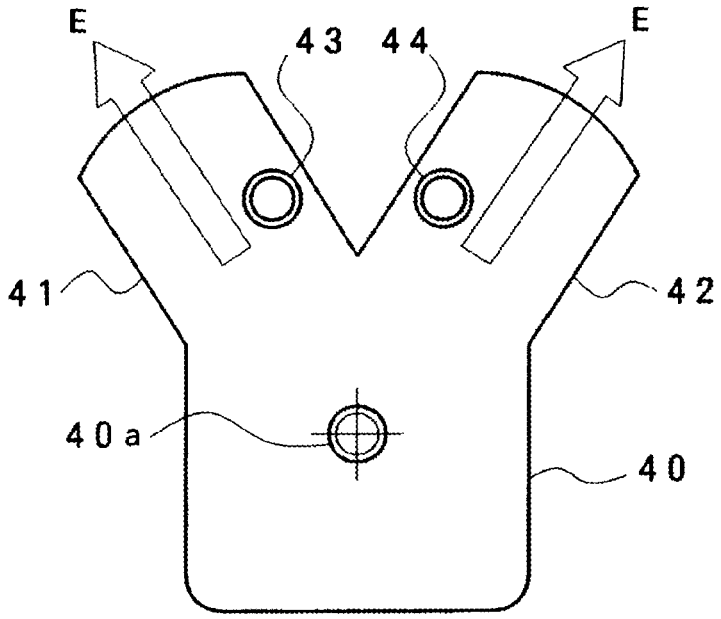
FIG. 5 is a view schematically showing thermal expansion of a V-engine.

Next, FIG. 5 et seq. show other preferred embodiments of the coolant passage apparatus of the present invention. Since the coolant passage apparatus of this preferred embodiment is directly connected to the V-engine, the apparatus is subjected to stress due to thermal expansion of the V-engine. In this case, as schematically shown in FIG. 5, thermal expansion occurs in the one pair of heads (banks) 41 and 42 of the V-engine 40 mainly in the direction indicated by arrows E, E due to temperature elevation when driving.

Therefore, the coolant passage apparatus 10 which is directly connected to coolant outlets 43 and 44 provided at both banks of the engine 40 is stressed in the direction where the coolant receiving pipes 23 and 24 are pulled in the left-and-right direction, in other words, in the direction indicated by arrow F in FIG. 7 to be set forth later. It is to be noted that 40*a* in FIG. 5 denotes a position of the crankshaft.

In the case where the junction face is arranged between the one pair of coolant receiving pipes, because the coolant receiving pipes 23 and 24 are pulled in the left-and-right direction, the apparatus can break due to the stress concentration on the junction portion. In order to increase junction strength to resist the breakage, countermeasures such as increasing the junction area and changing the junction shape need to be taken. And as a result, cost can be increased and the shape and structure can become complicated.

Incidentally, in the first preferred embodiment shown in FIGS. 1 to 4, for example as shown in FIG. 2, the first body 21 and second body 22 are formed to be bent slightly, substantially in the center thereof. By this structure, stress is concentrated on the above-mentioned bend, and level of damage to the above-mentioned bend increases due to being subjected to repeated stress.

Figure 6:
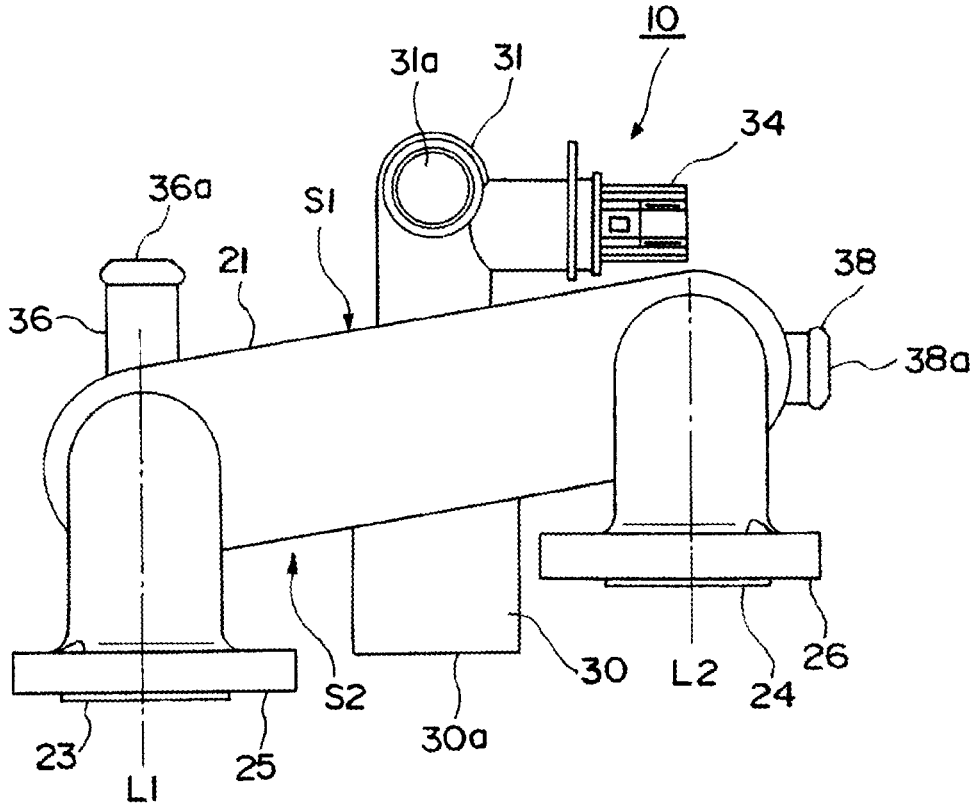
FIG. 6 is a front view showing another preferred embodiment of the coolant passage apparatus.

Then, in a second preferred embodiment shown in FIG. 6, in order to cope with the above-mentioned stress, the coolant apparatus 10 has no bend as mentioned above, and thus stress is not imposed on a specific part thereof. FIG. 6 shows the coolant passage apparatus 10 as viewed from top and the same reference characters are used for components that correspond to those shown in FIG. 2 as already described.

In the structure shown in FIG. 6, the junction portion of the above-mentioned first body and second body, viewed from above the coolant passage apparatus, is formed in a straight line (shown by characters S1 and S2) in a region surrounded by respective vertical planes which are orthogonal to a plane defined by connecting the junction portion 21*a* and 22*a* of the above-mentioned first body 21 and second body 22 and pass through central axes L1 and L2 of the above-mentioned one pair of coolant receiving pipes 23 and 24.

Figure 7:
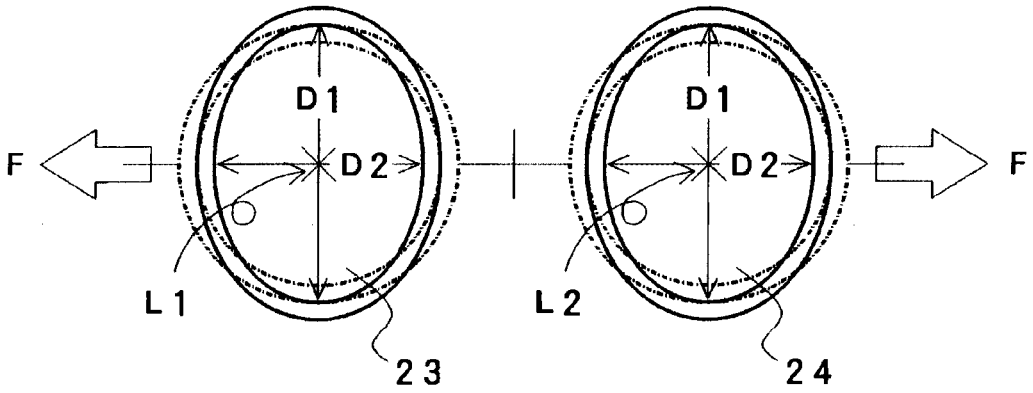
FIG. 7 is a view schematically showing a preferred embodiment of coolant receiving pipes.

According to the above-mentioned structure shown in FIG. 6, even if a portion between the central axes L1 and L2 of the coolant receiving openings 23 and 24 are pulled outwardly each other in the direction of arrow F as shown in FIG. 7, since the junction portion therebetween is formed in a straight line, it is possible to prevent a traction force caused by the above-mentioned stress from being imposed on a specific part of the first body 21 or second body 22. Even if the apparatus is subjected to the above-mentioned stress repeatedly, it is thereby possible to increase the strength for this and provide a coolant passage apparatus with high durability and reliability.

Next, FIG. 7 shows a third preferred embodiment of the coolant passage apparatus of this invention, and it shows shapes of the coolant receiving pipes 23 and 24 for example by a sectional view taken along line A-A in FIG. 2 in the direction of arrows. As mentioned above, the stress due to thermal expansion of the V-engine is imposed in the direction in which the coolant receiving pipes 23 and 24 are pulled in left-and-right direction, in other words, in the direction indicated by arrows F, F in FIG. 7.

It is to be noted that since this coolant passage apparatus is mounted to the left and right engine heads of the V-internal combustion engine, even if the engine heads thermally expand in the direction indicated by arrow E in FIG. 5, the coolant passage apparatus moves integrally in the same direction, that is, moves upwardly in FIG. 5. Thus, the coolant passage apparatus is subjected to little stress in the vertical direction.

Therefore, in the case where the coolant receiving pipes 23 and 24 are formed in a complete circle beforehand, because the stiffness is high, stress is not absorbed in the pipes but concentrated on other part. In view of pressure loss, these pipes 23 and 24 are preferably formed such that they become a substantially complete circle when stress is imposed thereon. Thus, the above-mentioned pipes 23 and 24 are preferably formed in an elliptical shape, being of a large inner diameter in a direction orthogonal to the direction indicated by arrows F, F (shape indicated by solid-line in FIG. 7) at ambient temperature.

By employing such an elliptical shape, when being subjected to the above-mentioned stress in the direction indicated by arrows F, F, the pipes can be substantially complete circle as indicated by dashed line. In other words, by subjecting the side of ellipse to stress first and forming into complete circle, it is possible to absorb the imposed stress and prevent (relieve) the stress from being imposed on, other parts of the apparatus (for example, junction portion between the above-mentioned respective bodies and root portion of the pipe).

According to the above-mentioned reasons, the above-mentioned one pair of coolant receiving pipes 23 and 24 are preferably formed in an elliptical shape, being of a large inner diameter D1 in a direction orthogonal to a plane which respectively connects central axes L1 and L2 of the above-mentioned one pair of pipes, and a small inner diameter D2 in a direction of the plane which connects the above-mentioned central axes. It is thereby possible to reduce degree of pressure drop provided in the flow of the coolant during temperature elevation of the engine.

Figure 8:
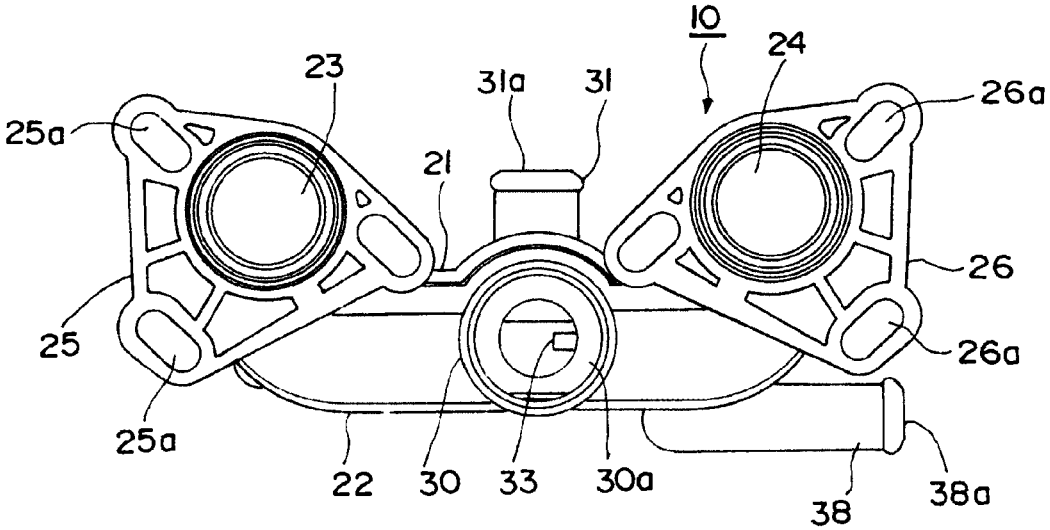
FIG. 8 is a front view showing still another preferred embodiment of the coolant passage apparatus.

Next, FIG. 8 shows a forth preferred embodiment of the coolant passage apparatus of the present invention. That is, FIG. 8 shows the coolant passage apparatus 10 as viewed from front side, and the same reference characters are used for components that correspond to those shown in FIG. 3 as already described. In this embodiment, flange-like joints (flange) 25 and 26 are formed respectively around the openings of the coolant receiving pipes 23 and 24 and the joints have formed therein bolt inserting long holes 25*a* and 26*a*. In other words, these long holes 25*a* and 26*a* are formed such that a longitudinal direction thereof is along a bank angle E from the crankshaft 40*a* towards the left and right engine heads 41 and 42 as shown in FIG. 5.

It is to be noted that in the preferred embodiment shown in FIG. 8, although the long holes 25*a* and 26*a* are respectively formed so as to be along the direction of the one pair of bank angle E of the V-engine, these holes can be formed laterally.

Figure 9:
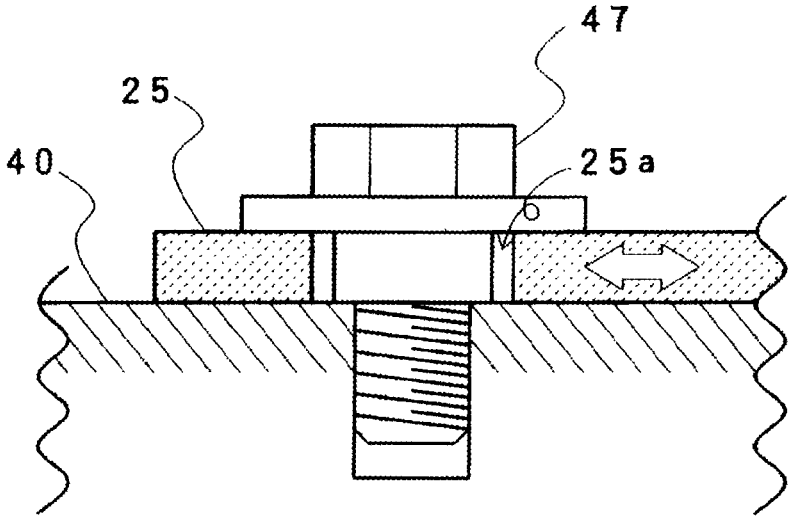
FIG. 9 is a partially enlarged sectional view of the preferred embodiment in FIG. 8

FIG. 9 is an enlarged sectional view showing an example of connecting the coolant passage apparatus to the head of the engine 40 by bolt 47 by using one of the long holes 25*a*. As shown in FIG. 9, the flange-like joint 25 is crimped and thus mounted to the engine 40 by the bolt 47 which is inserted through the long hole 25*a*. Then, the bolt 47 which is engaged with the head of the engine 40 slides in the longitudinal direction of the long hole 25*a* formed in the above-mentioned joint 25 due to thermal expansion of the engine caused by temperature elevation. Stress imposed on the coolant passage apparatus can thereby be released.

In addition, according to the above-mentioned fourth preferred embodiment, since a large fastener seating surface of step bolt 47 can be prepared in comparison to the coolant receiving pipes 23 and 24 having large inner diameters, it is possible to prevent occurrence of creep which is peculiar to resin.

It is to be noted that in the above-mentioned preferred embodiments, although the junction portion of respective bodies constituting the coolant passage apparatus is formed so as to be parallel to a plane along the axial direction of the crankshaft of the engine, this is suitably used for an FR vehicle in which the internal combustion engine provided with the coolant passage apparatus of the present invention is arranged vertically (so that a longitudinal direction of the crankshaft is a direction of movement of the vehicle).

In the case of the above-mentioned FR vehicle, since there is enough space in the front-and-rear direction in an engine compartment, it is possible to employ the L-shaped bent structure for the coolant receiving pipes 23 and 24 as shown in the preferred embodiments. Thus, in this case, the junction portion between the first body 21 and second body 22 is preferably formed in the horizontal plane direction.

In addition, in the case of an FF vehicle having the internal combustion engine arranged horizontally (so that the longitudinal direction of the crankshaft is width direction of the vehicle), since there is not enough space in the left-and-right direction in the engine compartment, it is necessary to design a dimension in the front-and-rear direction of the coolant passage apparatus as small as possible. Thus, the above-mentioned junction face between the first body 21 and the second body 22 is preferably formed so as to be parallel to a plane orthogonal to the axial direction of the crankshaft of the above-mentioned internal combustion engine.

In the preferred embodiments as described above, the description is carried out with reference to the case where the coolant passage apparatus 10 is structured by joining the first body 21 and the second body 22 formed from synthetic resin, but the coolant passage apparatus can be formed by joining three or more divided resin moldings as needed.

In addition, the above-mentioned shapes of connection portions for connecting auxiliary devices such as the ATF warmer, heater and EGR cooler are not limited thereto and can of course be various shapes.

DESCRIPTION OF REFERENCE CHARACTERS

10 coolant passage apparatus
21 first body
21*a* junction portion
22 second body
22*a* junction portion
23, 24 coolant receiving pipe
25, 26 joint (flange)
25*a*, 26*a* long hole
27 collecting passage
30 communicating tube towards radiator
30*a* communication opening towards radiator
31*a* communication opening towards heater core
33 water temperature sensor
36*a* communication opening towards ATF warmer
38*a* communication opening towards EGR cooler

The invention claimed is:

1. A coolant passage apparatus used for a cooling device of an internal combustion engine in which a circulation channel for a coolant is formed between a fluid passage formed in a V-internal combustion engine and a radiator, and provided between a coolant outlet of said internal combustion engine and a coolant inlet of said radiator, characterized in that said coolant passage apparatus is formed by joining two resin moldings constituted by a first body and a second body which are each individually molded, and at least a pair of coolant receiving pipes for respectively receiving the coolant from left and right engine heads of said V-internal combustion engine having a center plane which is along an axial direction of a crankshaft of said V-internal combustion engine and which symmetrically divides the left and right engine heads, a collecting passage for causing said one pair of coolant receiving pipes to communicate therewith and collecting the coolant, and a communicating tube which is towards said radiator for supplying the coolant to said radiator via said collecting passage are formed therein, and said one pair of coolant receiving pipes are respectively communicated with said collecting passage, with said collecting passage therebetween, and molded so as to respectively face the same direction, and said one pair of coolant receiving pipes are integrally molded in one resin molding of said first body and second body, and each of said first body and second body has one annularly formed junction portion, and said coolant passage apparatus has a configuration such that said collecting passage is formed by joining said junction portions of the first body and second body to each other, and said annularly formed junction portions of the first body and the second body are formed so as to be parallel to a plane along the axial direction of a crankshaft of said V-internal combustion engine, said annularly formed junction portions being formed to extend along a direction orthogonal to the center plane of said V-internal combustion engine.

2. A coolant passage apparatus used for a cooling device of an internal combustion engine in which a circulation channel for a coolant is formed between a fluid passage formed in a V-internal combustion engine and a radiator, and provided between a coolant outlet of said internal combustion engine and a coolant inlet of said radiator, characterized in that said coolant passage apparatus is formed by joining two resin moldings constituted by a first body and a second body which are each individually molded, and at least a pair of coolant receiving pipes for respectively receiving the coolant from left and right engine heads of said V-internal combustion engine having a center plane which is along an axial direction of a crankshaft of said V-internal combustion engine and which symmetrically divides the left and right engine heads, a collecting passage for causing said one pair of coolant receiving pipes to communicate therewith and collecting the coolant, and a communicating tube which is towards said radiator for supplying the coolant to said radiator via said collecting passage are formed therein, and said one pair of coolant receiving pipes are respectively communicated with said collecting passage, with said collecting passage therebetween, and molded so as to respectively face the same direction, and said one pair of coolant receiving pipes are integrally molded in one resin molding of said first body and second body, and each of said first body and second body has one annularly formed junction portion, and said coolant passage apparatus has a configuration such that said collecting passage is formed by joining said junction portions of the first body and second body to each other, and said annularly formed junction portions of the first body and the second body are formed so as to be parallel to a plane orthogonal to an axial direction of a crankshaft of said internal combustion engine, said annularly formed junction portions being formed to extend along a direction orthogonal to the center plane of said V-internal combustion engine.

3. The coolant passage apparatus as claimed in claim 1, characterized in that a junction portion of said first body and second body, viewed from above the coolant passage apparatus, is formed in a straight line in a region surrounded by respective vertical planes which are orthogonal to a plane defined by connecting the junction portion of said first body and second body and pass through central axes of said pair of coolant receiving pipes.

4. The coolant passage apparatus as claimed in claim 1 or 2, characterized in that said one pair of coolant receiving pipes are formed in an elliptical shape, being of a large inner diameter in a direction orthogonal to a plane which connects central axes of respective pipes, and a small inner diameter in a direction of the plane which connects said central axes.

5. The coolant passage apparatus as claimed in claim 1 or 2, characterized in that flange-like joints are formed respectively around openings of said one pair of coolant receiving pipes and each of the joints has formed therein bolt inserting long holes along a bank angle from the crankshaft towards the left and right engine heads.

6. The coolant passage apparatus as claimed in claim 1, wherein both of each central axis of said one pair of coolant receiving pipes are positioned on one side of the coolant passage apparatus via the joined junction portions of said first body and second body, and central axis of said collecting passage for collecting the coolant is positioned on the other side.

7. The coolant passage apparatus as claimed in claim 2, wherein both of each central axis of said one pair of coolant receiving pipes are positioned on one side of the coolant passage apparatus via the joined junction portions of said first body and second body, and central axis of said collecting passage for collecting the coolant is positioned on the other side.

* * * * *